US006105690A

United States Patent [19]

Biglin, Jr. et al.

[11] Patent Number: 6,105,690

[45] Date of Patent: Aug. 22, 2000

[54] METHOD AND APPARATUS FOR COMMUNICATING WITH DEVICES DOWNHOLE IN A WELL ESPECIALLY ADAPTED FOR USE AS A BOTTOM HOLE MUD FLOW SENSOR

[75] Inventors: Denis P. Biglin, Jr.; William E. Turner, both of Bethlehem, Pa.; Walter A. Helm, Farmington, Conn.

[73] Assignee: APS Technology, Inc., Cromwell, Conn.

[21] Appl. No.: 09/086,418

[22] Filed: May 29, 1998

[51] Int. Cl.[7] ..... E21B 47/12

[52] U.S. Cl. ..... 175/48; 175/50; 166/250.01

[58] Field of Search ..... 175/40, 46, 48, 175/50; 166/113, 324, 250.01

[56] References Cited

U.S. PATENT DOCUMENTS

| | | | |
|---|---|---|---|
| 2,901,685 | 8/1959 | Alder | 323/74 |
| 2,964,116 | 12/1960 | Peterson | 175/48 |
| 2,973,505 | 2/1961 | Johannesen | 340/18 |
| 3,065,416 | 11/1962 | Jeter | 324/70 |
| 3,302,457 | 2/1967 | Mayes | 73/152 |
| 3,309,656 | 3/1967 | Godbey | 340/18 |
| 3,693,428 | 9/1972 | Le Peuvedic et al. | 73/151 |
| 3,727,179 | 4/1973 | Bennett | 340/15.5 DT |
| 3,732,728 | 5/1973 | Fitzpatrick | 73/151 |
| 3,736,558 | 5/1973 | Cubberly, Jr. | 340/18 LD |
| 3,737,843 | 6/1973 | Le Peuvedic et al. | 340/18 NC |
| 3,739,331 | 6/1973 | Godbey et al. | 340/18 LD |
| 3,742,443 | 6/1973 | Foster et al. | 340/18 LD |
| 3,764,968 | 10/1973 | Anderson | 340/18 NC |
| 3,764,970 | 10/1973 | Manning | 340/18 NC |
| 3,770,006 | 11/1973 | Sexton et al. | 137/499 |
| 3,958,217 | 5/1976 | Spinnler | 340/18 LD |
| 3,964,556 | 6/1976 | Gearhart et al. | 175/45 |
| 4,038,632 | 7/1977 | Parker | 340/18 NC |
| 4,351,037 | 9/1982 | Scherbatskoy | 175/40 X |
| 4,483,394 | 11/1984 | Peppers et al. | 166/113 |
| 4,499,955 | 2/1985 | Campbell et al. | 175/46 |
| 4,553,598 | 11/1985 | Meek et al. | 166/317 |
| 4,628,495 | 12/1986 | Peppers et al. | 175/40 X |
| 4,790,393 | 12/1988 | Larronde et al. | 175/40 |
| 4,796,699 | 1/1989 | Upchurch | 166/250 |
| 4,856,595 | 8/1989 | Upchurch | 166/374 |
| 4,915,168 | 4/1990 | Upchurch | 166/250 |
| 5,079,750 | 1/1992 | Scherbatskoy | 367/85 |
| 5,113,379 | 5/1992 | Scherbaskoy | 367/83 |
| 5,144,245 | 9/1992 | Wisler | 324/338 |
| 5,280,243 | 1/1994 | Miller | 324/303 |
| 5,691,712 | 11/1997 | Meek et al. | 340/853.3 |

OTHER PUBLICATIONS

Ryan Energy Technologies, Inc., "Electronic Flow Switch (EFS)", New Technology Bulletin, Offshore Technology Conference, Houston, TX, May 7, 1998, 1 page.

Piezo Kinetics Incorporated, "The Piezoelectric Effect", Piezoceramics—Application Notes, pp. 1–8 (1994).

*Primary Examiner*—Frank Tsay

*Attorney, Agent, or Firm*—Woodcock Washburn Kurtz Mackiewicz & Norris LLP

[57] ABSTRACT

A method and apparatus for communicating with a device downhole in a well, such as a bottom hole assembly in a drill string. Pressure pulses, such as those generated by the pistons of the mud pump, are transmitted through the drilling mud to a pressure pulsation sensor in the bottom hole assembly. The pressure pulsation sensor features a piezoceramic element that generates a varying voltage signal in response to the received pressure pulsations. The pressure pulsation sensor also has electronic components that allow it to analyze a characteristic of the pressure pulsations, such as their frequency. Based on its analysis of the pressure pulsations, the sensor can decipher a command from the surface, for example, that directs the steering of a steerable drill string, or that can determine whether the mud pumps are operating. If the mud pumps are not operating the sensor directs a microprocessor to reduce power to the bottom hole assembly electrical components, such as a measurement while drilling tool, thereby conserving battery power. The method and apparatus can also be used to control the operation of flow control valves in a multilateral well.

40 Claims, 10 Drawing Sheets

METHOD AND APPARATUS FOR COMMUNICATING WITH DEVICES DOWNHOLE IN A WELL ESPECIALLY ADAPTED FOR USE AS A BOTTOM HOLE MUD FLOW SENSOR

FIELD OF THE INVENTION

The current invention is directed to an apparatus and method for communicating information from the surface to devices downhole in a well, including the bottom hole assembly of a drilling apparatus, by generating pressure pulses in the fluid in the well. The apparatus and method are especially adapted for use as a bottom hole mud flow sensor in a drill string or to control valves in a producing well.

BACKGROUND OF THE INVENTION

In underground drilling, such as gas, oil or geothermal drilling, a bore is drilled through a formation deep in the earth. Such bores are formed by connecting a drill bit to sections of long pipe, referred to as a "drill pipe," so as to form an assembly commonly referred to as a "drill string" that extends from the surface to the bottom of the bore. The drill bit is rotated so that it advances into the earth, thereby forming the bore. In rotary drilling, the drill bit is rotated by rotating the drill string at the surface. In directional drilling, the drill bit is rotated by a down hole mud motor coupled to the drill bit; the remainder of the drill string is not rotated during drilling. In a steerable drill string, the mud motor is bent at a slight angle to the centerline of the drill bit so as to create a side force that directs the path of the drill bit away from a straight line. In any event, in order to lubricate the drill bit and flush cuttings from its path, piston operated pumps on the surface pump a high pressure fluid, referred to as "drilling mud," through an internal passage in the drill string and out through the drill bit. The drilling mud then flows to the surface through the annular passage formed between the drill string and the surface of the bore.

Depending on the drilling operation, the pressure of the drilling mud 10 flowing through the drill string will typically be between 1,000 and 20,000 psi. In addition, there is a large pressure drop at the drill bit so that the pressure of the drilling mud flowing outside the drill string is considerably less than that flowing inside the drill string. Thus, the components within the drill string are subject to large pressure forces. In addition, the components of the drill string are also subjected to wear and abrasion from drilling mud, as well as the vibration of the drill string.

The distal end of a drill string, which includes the drill bit, is referred to as the "bottom hole assembly." In "measurement while drilling" (MWD) applications, sensing modules in the bottom hole assembly provide information concerning the direction of the drilling. This information can be used, for example, to control the direction in which the drill bit advances in a steerable drill string. Such sensors may include a magnetometer to sense azimuth and accelerometers to sense inclination and toolface.

Historically, information concerning the conditions in the well, such as information about the formation being drill through, was obtained by stopping drilling, removing the drill string, and lowering sensors into the bore using a wire line cable, which were then retrieved after the measurements had been taken. This approach was known as wire line logging. More recently, sensing modules have been incorporated into the bottom hole assembly to provide the drill operator with essentially real time information concerning one or more aspects of the drilling operation as the drilling progresses. In "logging while drilling" (LWD) applications, the drilling aspects about which information is supplied comprise characteristics of the formation being drilled through. For example, resistivity sensors may be used to transmit, and then receive, high frequency wavelength signals (e.g., electromagnetic waves) that travel through the formation surrounding the sensor. By comparing the transmitted and received signals, information can be determined concerning the nature of the formation through which the signal traveled, such as whether it contains water or hydrocarbons. One such method for sensing and evaluating the characteristics of the formation is disclosed in U.S. Pat. No. 5,144,245 (Wisler), hereby incorporated by reference in its entirety. Other sensors are used in conjunction with magnetic resonance imaging (MRI) such as that disclosed in U.S. Pat. No. 5,280,243 (Miller), hereby incorporated by reference in its entirety. Still other sensors include gamma scintillators, which are used to determine the natural radioactivity of the formation, and nuclear detectors, which are used to determine the porosity and density of the formation.

In traditional LWD and MWD systems electrical power was supplied by a turbine driven by the mud flow. More recently, battery modules have been developed that are incorporated into the bottom hole assembly to provide electrical power.

In both LWD and MWD systems, the information collected by the sensors must be transmitted to the surface, where it can be analyzed. Such data transmission is typically accomplished using a technique referred to as "mud pulse telemetry." In a mud pulse telemetry system, signals from the sensor modules are typically received and processed in a microprocessor-based control module of the bottom hole assembly, which digitizes and stores the sensor data. The control module then actuates a pulser module, also incorporated into the bottom hole assembly, that generates pressure pulses within the flow of drilling mud, for example by opening and closing a valve through which the drilling mud flows. Various encoding systems have been developed wherein one or more characteristics of the pressure pulses, such as their frequency or duration, represent binary data (i.e., 1's and 0's)—for example, a pressure pulse of 0.5 second duration represents a zero, while a pressure pulse of 1.0 second duration represents a one. The pressure pulses travel up the flow of drilling mud returning to the surface, where they are sensed by a strain gage based pressure transducer. The data from the pressure transducers are then decoded and analyzed by the drill rig operating personnel. Mud pulse telemetry systems are described in U.S. Pat. No. 3,737,843 (LePeuvedic et al.), U.S. Pat. No. 3,770,006 (Sexton et al.), and U.S. Pat. No. 3,958,217 (Spinnler), each of which is hereby incorporated by reference in its entirety.

A predetermined format for the pressure pulses is used to allow the surface data acquisition system to decode the data. For example, the initial transmission may provide location/direction data—such as azimuth, inclination and toolface—followed by a continuously repeating pattern of sequential data from the gamma sensor, then the resistivity sensor, etc. This approach requires that the surface data acquisition system and the down hole communication system be synchronized. Unfortunately, for a variety of reasons, such as the reception of spurious pressure pulses by the surface pressure transducers, a loss of synchronization frequently occurs during drilling. In order to resynchronize the surface and down hole systems, it is necessary to direct the down hole system to re-initialize the data transmission. Moreover, in directional drilling, it is often periodically necessary to obtain updated information on location/direction that, after the initial transmission, is not thereafter continuously transmitted due to the time consuming nature of such data transmissions. Consequently, to obtain such updated information, the down hole system must again be instructed to re-initialize the data transmission.

Unfortunately, due to the length of drill string and the hostile environment in which it operates, it is not feasible to communicate directly with the bottom hole system using electrical conductors. Consequently, in the past, flow sensors have been incorporated into the bottom hole assembly that determine whether the drilling mud is flowing through the drill string. To cause the bottom hole assembly to re-initialize data transmission, the mud pumps are shut down, thereby causing the flow sensors to indirectly sense a lack of drilling mud flow based on pressure drop or vibration as discussed further below. The control module microprocessor is programed to re-initialized data transmission when the flow sensor signals the resumption of mud flow following its cessation.

In addition to the need to resynchronize or update the data transmission, it is also desirable to sense the cessation of mud flow in order to conserve power in a bottom hole assembly powered by a battery module. Mud flow is periodically ceased for a variety of reasons—such as to add a section of drill pipe as the bit digs deeper, or to replace the drill bit, or to make repairs. Maintaining operation of the bottom hole assembly electrical system during such outages unnecessarily shortens the life of the battery module.

In down hole assemblies supplied by electricity from a turbine driven by the mud flow, the cessation of mud flow will automatically cut-off electrical power to the bottom hole assembly. However, in battery operated systems, a flow sensor is required to detect the cessation of mud flow. Two types of mud flow sensors have been used in the past. The first type employs a mechanical pressure switch that senses the pressure drop in the drilling mud across an orifice, with a low $\Delta P$ indicating the cessation of mud flow and a high $\Delta P$ indicating the resumption of mud flow. The second type of flow sensor employs an accelerometer mounted in the bottom hole assembly to sense vibration in the drill string, with the absence of vibration indicating the cessation of mud flow and the presence of vibration indication the resumption of mud flow. Such accelerometers typically employ a quartz element with a mass which imparts a force on the element under vibration; this force, in turn, deflects the quartz element, generating an oscillating voltage representative of the vibration.

Unfortunately, such flow sensors have proven unreliable in operation. For example, pressure switches can become stuck and fail to react to the cessation of flow, while vibration sensors can be tripped by spurious vibrations, resulting in a false indication of mud flow. In addition, both types of sensors can be fooled by the flow of mud that can occur when the mud pump is shut down, such as flow through fissures in the bore that is driven by the pressure head of the mud column, referred to as "lost circulation" flow. Therefore, it would be desirable to provide a method and apparatus capable of reliably detecting the cessation and establishment of mud flow.

In addition to the need to determine the cessation and establishment of mud flow as a means for communicating a re-initialization command to the bottom hole assembly data transmission system, or to conserve battery power, it would also be desirable to communicate with the bottom hole assembly for other reasons. For example, communications from the surface could be used to control the direction of drilling in a closed loop steerable drill string, or to instruct the bottom hole assembly to transmit only data from a certain sensor for a period of time. Communications from the surface could also be used to modify the data transmission format to accommodate changes that occur as the drill bit advances. For example, pressure pulses transmitted at a 1 Hz frequency may become obscured due to background noise when the drill bit has advanced deeply into the hole—a situation that might be remedied by reducing the frequency to 0.5 Hz.

Recently, a system has been developed which utilizes mud flow rate to communicate information to those bottom hole assemblies that employ a turbine to supply electrical power. In this approach, information is communicated by varying the flow rate of the mud flow, which results in varying output from the turbine. Unfortunately, this approach permits the transmission of only crude information and cannot be used when mud flow has stopped, nor can it be used in battery powered bottom hole assemblies.

Therefore, it would also be desirable to provide a method and apparatus that permitted a variety of information to be communicated to the bottom hole assembly from the surface even when the mud was not flowing.

In addition to directing communications to a bottom hole assembly in a drill string, it would also be desirable to direct communications to devices down hole in a producing well. For example, in multilateral wells, oil flowing from different wells or zones is combined down hole so that the fluid discharged at the surface is a mixture. In order to control which branches of the well supply fluid, or how much fluid is supplied by each well branch, valves are installed in the various segments. Unfortunately, current techniques for controlling such valves are cumbersome, involving either installing conductors from the surface to the valve or descending a device down into the well to manually operate the valve. Therefore it would also be desirable to provide a method and apparatus that permitted an operator at the surface to control of a valve in a producing well from the surface without conductors.

SUMMARY OF THE INVENTION

It is an object of the current invention to provide a method and apparatus that permitted information, such as whether the mud pump is in operation, to be reliably communicated to the bottom hole assembly from the surface. This and other objects is accomplished in a method of communicating information to a bottom hole assembly from a location on the earth's surface in which the bottom hole assembly is surrounded by a fluid and is a portion of a drill string, comprising the steps of (i) directing pressure pulsations down the fluid to the bottom hole assembly from the surface location, the pressure pulsations having a characteristic indicative of the information, (ii) sensing the pressure pulsations received at the bottom hole assembly, and (iii) analyzing the pressure pulsation characteristic in the bottom hole assembly so as to decipher the information.

The invention also encompasses a method of drilling a bore in an earthen formation, comprising the steps of (i) pumping a drilling mud through the drill string to the drill bit whenever the drill bit is rotated so as to drill the bore, the drilling mud being pumped using at least one piston operating at a stroke rate so as to generate pressure pulsations in the drilling mud flowing through the drill string, (ii) sensing pressure pulsations in the drilling mud proximate the drill bit, and (iii) determining whether the drilling mud is being pumped through the drill string by analyzing a characteristic of the pressure pulsations sensed. In one embodiment, the method further comprises the steps of (i) sensing a characteristic of the formation using a sensor, and directing a flow of electricity to the sensor, and (ii) reducing the flow of electricity to the sensor if it is determined that the drilling mud is not being pumped through the drill string.

In a preferred embodiment, the step of sensing pressure pulsations in the drilling mud comprises causing the pressure of the drilling mud to deflect a piezoceramic element disposed proximate the drill bit so as to produce a voltage within the piezoelectric element, the amplitude of the voltage being proportional to the amplitude of the pressure.

The invention also encompasses an apparatus for use in a bottom hole assembly of a drill string for sensing pressure pulsation in a drilling fluid surrounding the bottom hole assembly, comprising (i) a housing, (ii) a flexible diaphragm mounted in the housing, the diaphragm having a face exposed to the drilling fluid, (iii) a piezoceramic element coupled to the diaphragm face so that deflections of the diaphragm cause deflections of the piezoceramic element, the piezoelectric electric element having means for generating a varying voltage signal in response to the deflections thereof, and (iv) means for analyzing the varying voltage signal. In one embodiment, the means for analyzing the varying voltage signal comprises a filter.

The invention also encompasses a method of controlling a device in a fluid filled well from a location on the earth's surface by communicating instructions thereto, the method comprising the steps of (i) locating a sensor in the well proximate the device, (ii) directing pressure pulsations down the fluid to the sensor from the surface location, the pressure pulsations having a characteristic indicative of the instructions to be communicated, (iii) sensing the pressure pulsations received by the sensor, (iv) analyzing the characteristic of the pressure pulsations so as to decipher the instructions, the analysis being conducted in the sensor, and (v) sending a signal from the sensor to the device instructing the device in accordance with the instructions deciphered by the sensor.

The invention also encompasses an apparatus for use down hole in a well for controlling the flow of fluid from the well, comprising (i) a fluid flow control device for controlling the flow of fluid downhole in the well, the fluid control device having means for controlling the flow of fluid in response to a signal received, (ii) means for generating pressure pulsations in the fluid proximate the surface of the earth, the pressure pulsations having a characteristic indicative of an instruction for operating the fluid flow control device, (iii) a sensor assembly for sensing the pressure pulsations at a location down hole in the well, and (iv) means for analyzing a characteristic of the pressure pulsations sensed and for sending a signal to the fluid flow control device instructing the device to operate in accordance with the instruction.

DESCRIPTION OF THE PREFERRED EMBODIMENT

Figure 1:
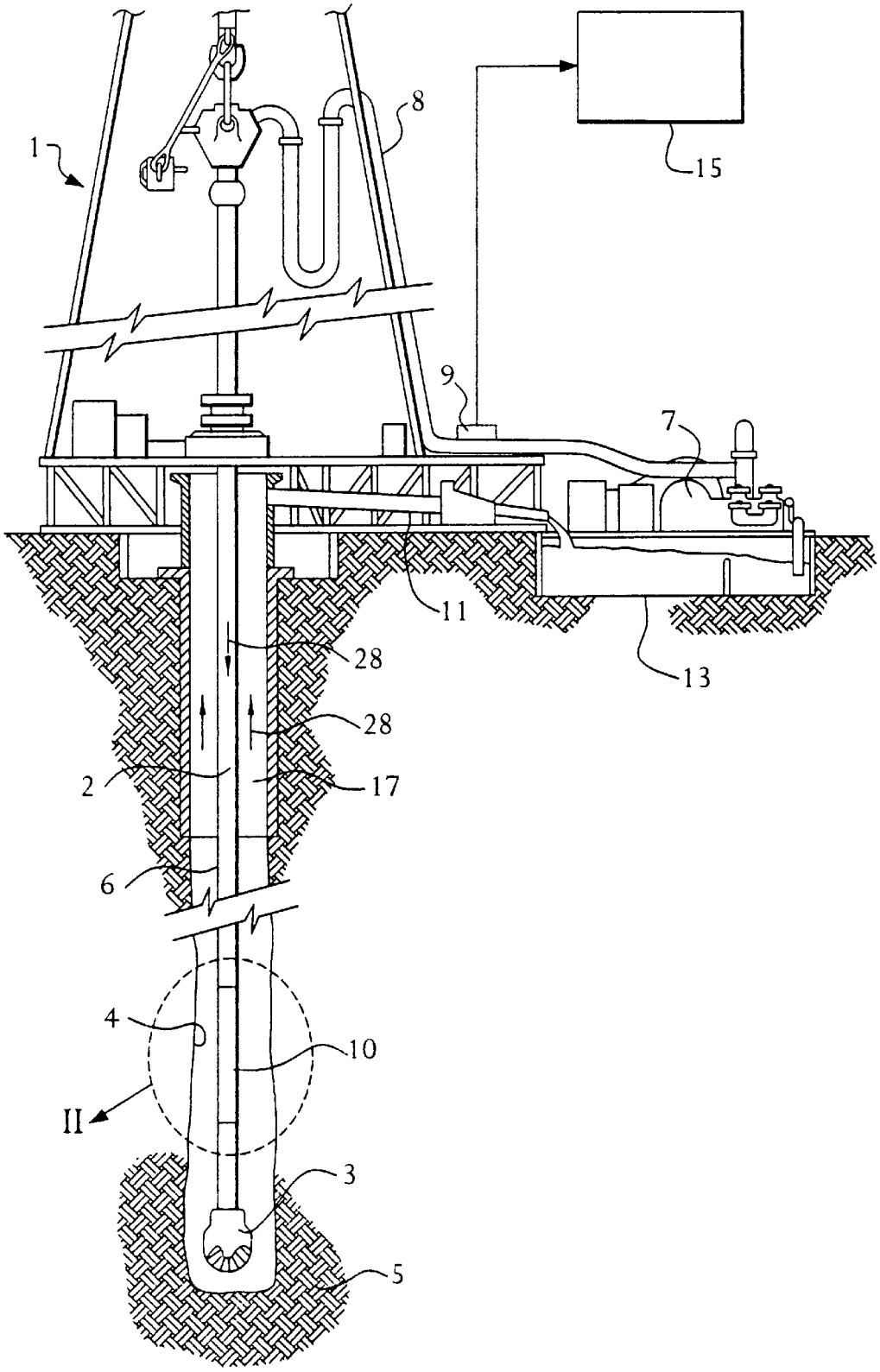
FIG. 1 is a diagram, partially schematic, of a drilling operation employing a drill string incorporating the bottom hole assembly of the current invention.

A drilling operation according to the current invention is shown in FIG. 1. A drill rig 1 drives a drill string 6 that, as is conventional, is comprised of a number of interconnected sections. A drill bit 3 at the extreme distal end of the drill string 6 advances into an earthen formation 5 so as to form a bore 4. A mud pump 7, which typically has two or three pistons, causes drilling mud 28 to flow from a mud tank 13 through a pipe 8 and into the drill string 6. The drilling mud 28 then flows through a central passage in the drill pipe 6 to a bottom hole assembly 10, which is formed at the distal end of the drill string 6. From the bottom hole assembly 10, the drilling mud 28 flows out through the drill bit 3 and returns to the surface through the annular passage 17 formed between the bore 4 and the drill string 6. At the surface, the drilling mud 28 is returned to the tank 13 via pipe 11.

Figure 2:
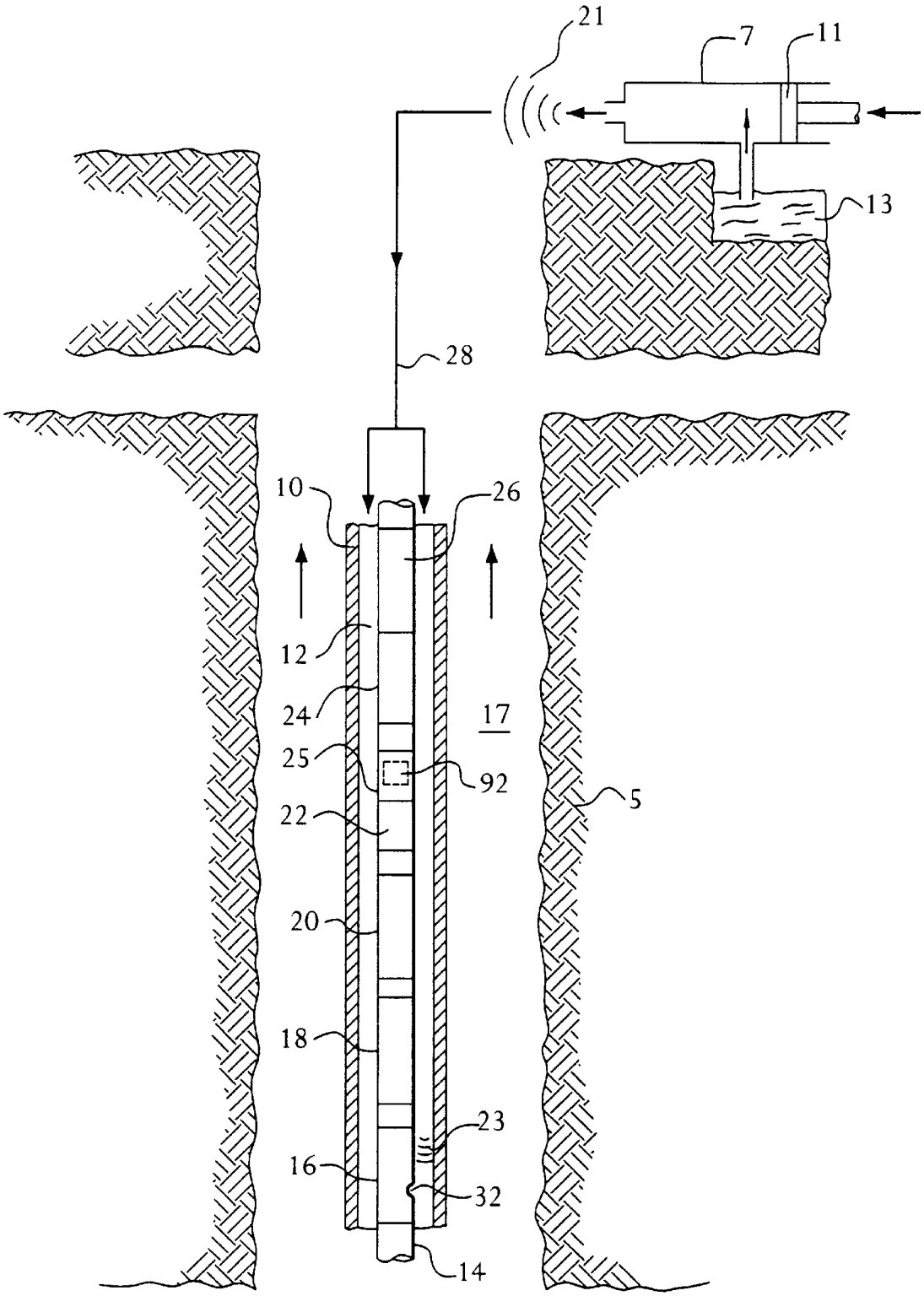
FIG. 2 is an enlarged view showing the portion of the drill string shown in FIG. 1 enclosed by the oval marked II, as well as equipment at the surface.
Figure 3:
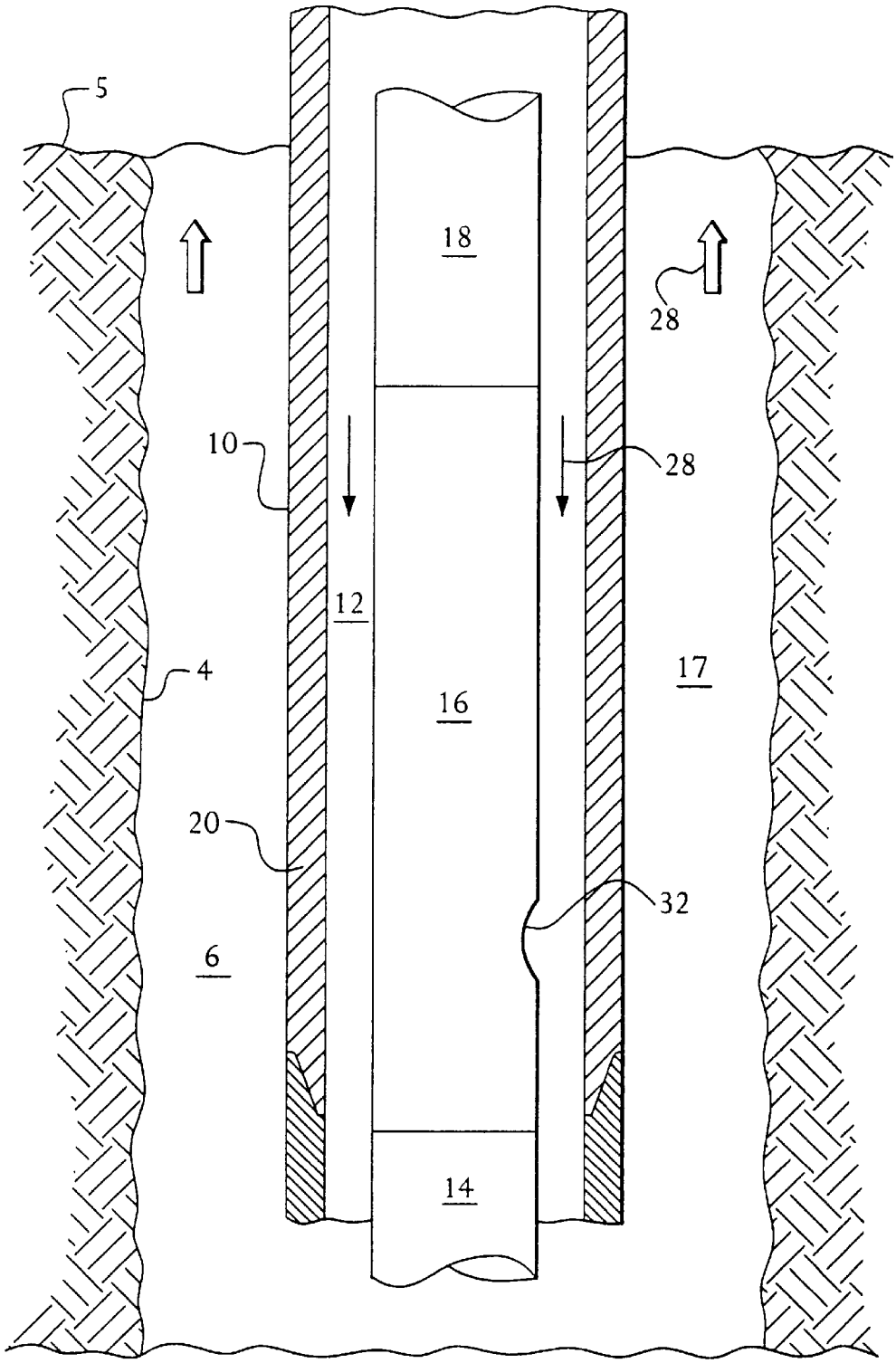
FIG. 3 is view of a portion of the bottom hole assembly shown in FIG. 2 in the vicinity of the pressure pulsation sensor of the current invention.
Figure 5:
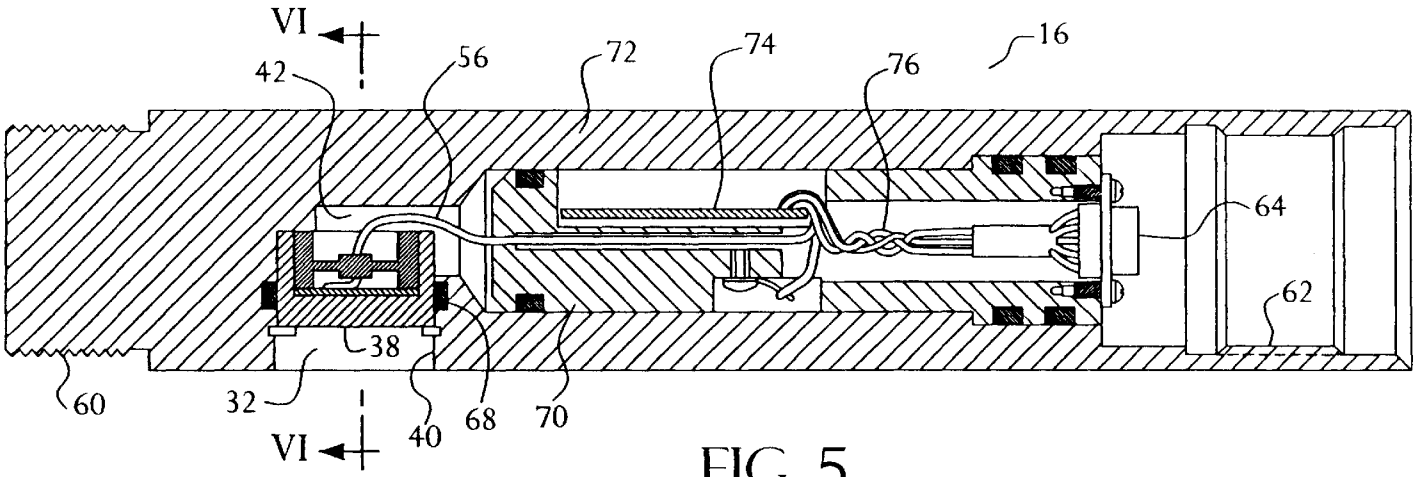
FIG. 5 is a longitudinal cross-section taken along line V—V shown in FIG. 4.
Figure 4:
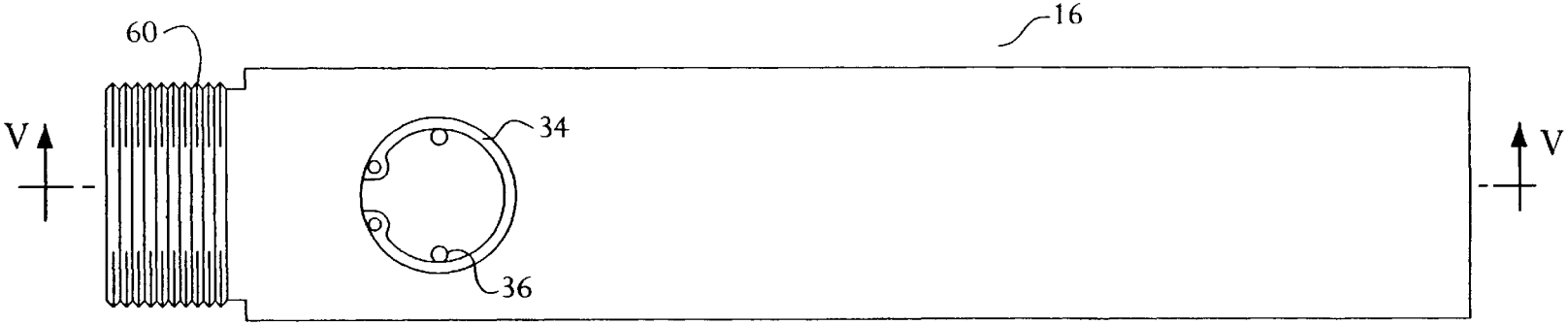
FIG. 4 is side view of the pressure pulsation sensor shown in FIG. 3.

As shown in more detail in FIG. 2, in addition to the drill bit 3, the bottom hole assembly 10 is comprised of an MWD tool. In one embodiment of the invention, the MWD tool comprises a mud pulser 26, which, as previously discussed, uses techniques well known in the art to send pressure pulses from the bottom hole assembly 10 to the surface via the drilling mud 28. As is conventional, a strain gage based pressure transducer 9 at the surface senses the pressure pulses and transmits electrical signals to a data acquisition and analysis system 15 where the data encoded into the mud pulses is decoded and analyzed. In addition, the MWD tool includes a solenoid driver 24 that drives the pulser valve, a control module 25 that contains a microprocessor 92, a directional sensor 22 that provides the directional information transmitted by the pulser 26, a battery module 20 that provides electrical power for the bottom hole assembly, a gamma sensor 18 that provides information concerning the natural radioactivity of the formation 5 that is transmitted by the pulser, a pressure pulsation sensor 16 according to the current invention, and a mud motor 14, which may be steerable. In addition, centralizer sections may be mounted between the foregoing sections. However, as those skilled in the art will readily appreciate, many different configurations of bottom hole assemblies and MWD tools can be used. For example, other types of sensors, such as nuclear detectors, resistivity sensors, etc., may be incorporated into the MWD tool.

As shown in FIG. 2, the pistons 11 of the mud pump 7 generate pressure pulsations 21 in the drilling mud 28 being pumped down the drill string 6. Each piston 11 generates pulsations at a frequency that is equal to the rate at which the piston strokes so that the pressure pulsations will have a frequency equal to the number of pistons multiplied by the stroke rate. Typically, mud pump pistons 11 stroke at a rate in the range of about 30 to 150 strokes per minute. Thus, a simplex mud pump will generate pressure pulsations 21 at a frequency in the range of 0.5 to 2.5 Hz. However, a duplex pump, which employs two pistons, which are not in phase, will generate pressure pulsations 21 having a frequency in the range from 1.0 to 5.0 Hz, while a triplex pump, which employs three pistons, will generate pressure pulsations having a frequency in the range from 1.5 to 7.5 Hz. The pressure pulsations 21 travel down the column of drilling mud within the passage 12 formed within drill string 6 and are eventually received as attenuated pressure pulsations 23 at the bottom hole assembly 10.

According to the current invention, the pressure pulsations 23 are detected and analyzed by the pressure pulsation sensor 16, discussed in detail below. By analyzing a characteristic of the pressure pulsations 23, the pressure pulsation sensor electronics, also discussed below, determines whether the pressure pulsations indicate that the mud pump 7 is in operation. If the sensor 16 previously determined that the pressure pulsations 23 were indicative of mud pump operation and it continues to so determine, no action is taken. If, however, based on an analysis the pressure pulsations, or lack thereof, the sensor 16 determines that operation of the mud pumps has ceased, it signals the programmable microprocessor 92 that operation of the mud pump 7 has ceased. The microprocessor 92 will then respond to such a signal according to preprogramed instructions.

In a preferred embodiment of the invention, the microprocessor 92 responds to a signal indicating cessation of operation of the mud pump 7 by cutting off, or at least reducing, power to the sensors and other consumers of electrical power within the MWD tool. Electrical power is not restored until the pressure pulsation sensor 16 determines that operation of the mud pump 7 has resumed, as discussed below. Eliminating or reducing electrical power consumption whenever the mud pump 7 is not in operation, in which case drilling will have ceased, conserves the life of the battery module 20, thereby extending the time between outages of the drill rig required to replace the batteries in the battery module 20, and reduces the MWD operating costs. Thus, when a pressure pulsation sensor 16 according to the current invention is utilized, mud pump shut downs effected in order to add a section of drill pipe, replace the drill bit 3, repair a drill string component, etc., will not shorten the life of the battery module 20.

According to a preferred embodiment of the invention, the pressure pulsation sensor 16 continues to sense and analyze pressure pulsation proximate the bottom hole assembly 10 after it has been determined that the mud pump has stopped. If, based on this analysis, the sensor 16 determines that operation of the mud pumps has resumed, it signals the programmable microprocessor 92. The microprocessor 92 will then respond to such a signal according to another set of preprogramed instructions. For example, the microprocessor 92 may respond by restoring full power to the MWD tool, thereby allowing sensing and data transmission by the pulser 26 to resume. Preferably, the microprocessor 92 also responds to such a signal from the sensor 16 by re-initiating the data transmission sequence. As previously discussed, this can include transmission of directional data and can permit the surface data acquisition system 15 to be synchronized with the data transmission from the bottom hole assembly 10. Thus, according to the current invention, functions such as obtaining directional data and restoring data synchronization can be reliably accomplished by tripping and then restarting the mud pump 7.

Figure 6:
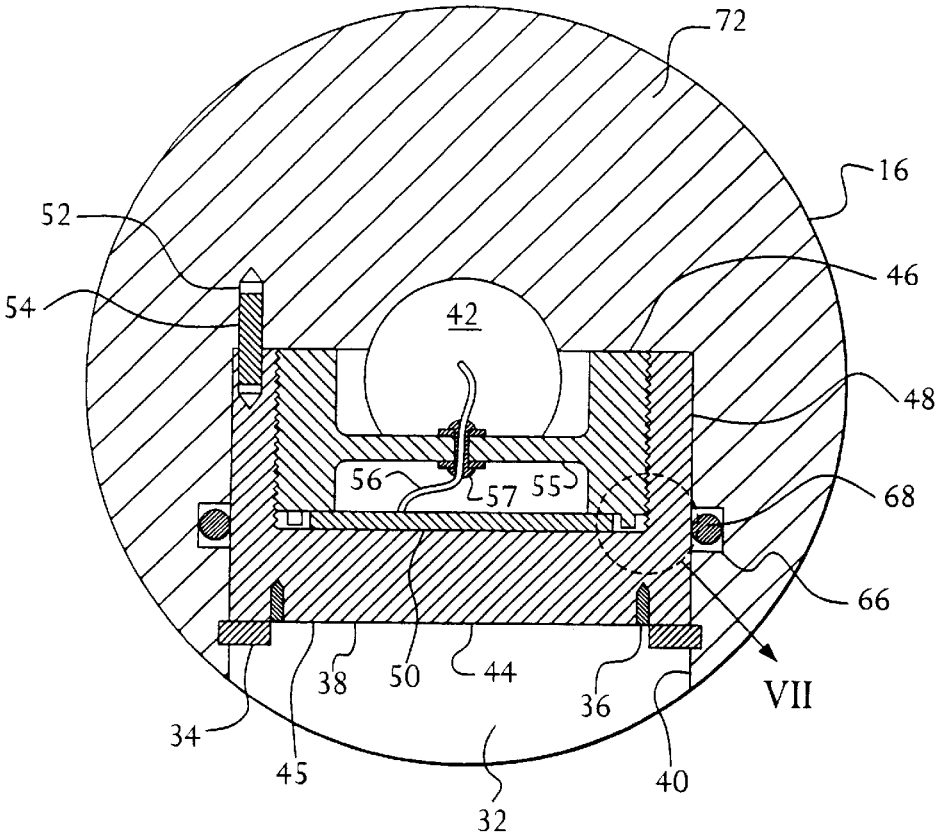
FIG. 6 is a transverse cross-section taken along line VI—VI shown in FIG. 5.
Figure 8:
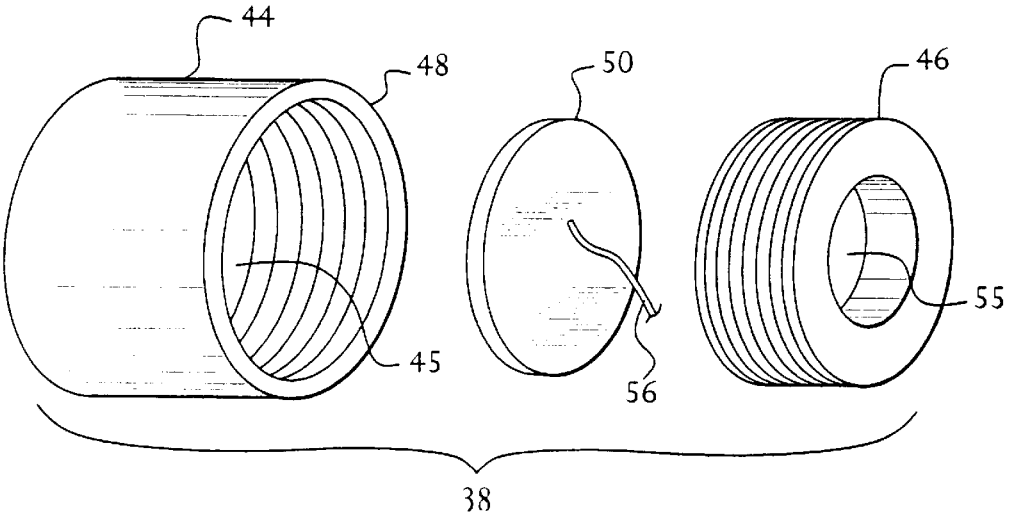
FIG. 8 is an exploded, isometric view of the piezoceramic sensor assembly shown in FIGS. 5 and 6.
Figure 7:
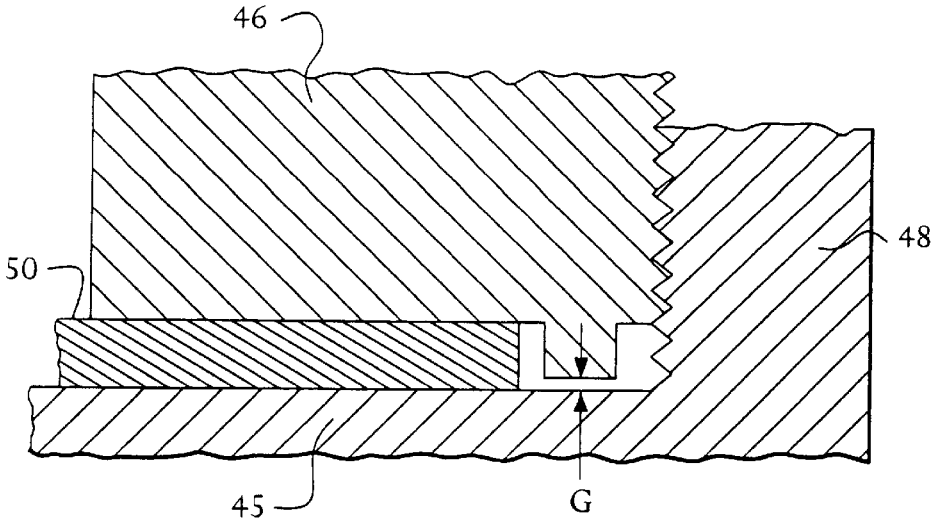
FIG. 7 is a detailed view of the portion of the pressure pulsation sensor assembly shown in FIG. 6 enclosed by the circle denoted VII.

A preferred embodiment of the pressure pulsation sensor 16 is shown in FIGS. 4–8. The sensor 16 comprises a cylindrical, metallic housing 72 on which external threads 60 are formed at one end and internal threads 62 are formed at the other end, thereby allowing the sensor to be coupled and supported by adjacent modules of the bottom hole assembly or the MWD tool. A circular recess 32 is formed in the side of the housing 72 so as to form a window through which drilling mud 28 may enter. A pressure sensor assembly 38, shown best in FIGS. 6 and 8, is mounted within the recess 32. A snap ring 34 inserted into a circular groove formed in the side wall 40 of the recess 32 maintains the sensor assembly 38 in place. An O-ring seal 68 is incorporated within a second circular groove 66 formed in the recess side wall 68 and prevents drilling mud from entering the internal portion of the sensor 16.

As shown best in FIG. 6, the sensor assembly 38 is comprised of a diaphragm 44 formed by a circular face portion 45 and a rearwardly extending cylindrical skirt portion 48. The diaphragm 44 must be sufficiently strong to withstand the pressure of the drilling mud 28, which can be as high as 25,000 psi. However, it should also have a relatively low modulus of elasticity so as to be sufficiently elastic to dynamically respond to the pressure pulsations, the magnitude of which may be as low as 1 psi by the time they reach the sensor 16. Preferably, the diaphragm 38 is formed from titanium. Threaded holes 36 are formed in the front surface of the diaphragm face 45 to facilitate removal of the sensor assembly 38.

According to one important aspect of the invention, a piezoelectric element 50 is mounted adjacent, and in surface contact with, the diaphragm 44. While piezoelectric elements can be made from a variety of materials, preferably, the piezoelectric element 50 is a piezoceramic element, which has a relatively high temperature capability (by contrast, piezoplastics, for example, cannot be used at temperatures in excess of 150° F.) and creates a relatively high voltage output when subjected to a minimum amount of strain. According to the piezoelectric phenomenon, certain crystalline substances, such as quartz and come ceramics, develop an electrical field when subjected to pressure. The piezoceramic element 50 according to the invention is preferably formed by forming a dielectric material, such as lead Metaniebate or lead zirconate titanate, into the desired shape, in this case, a thin disk. Electrodes are then applied to the material. The dielectric material is heated to an elevated temperature in the presence of a strong DC electric field, which polarizes the ceramic so that the molecular dipoles are aligned in the direction of the applied field, thereby imparting dielectric properties to the element.

Piezoceramic elements 50 have several attributes that make them especially suitable for down hole pressure pulsation sensing. They are compact. In one embodiment of a pressure pulsation sensor 16, the piezoceramic element 50 is approximately only 0.8 inch in diameter and 0.02 inch thick. Piezoelectric elements consume relatively little electric power compared to strain gage based pressure transducers. Also, unlike strain gage based pressure transducers, the piezoceramic element 50 is not affected by static pressure, which would otherwise create a DC offset, because the voltage change that occurs when a piezoceramic element is stressed is transient, returning to zero in a short time even if the stress is maintained. Suitable piezoceramic elements are available from Piezo Kinetics Incorporated, Pine Street and Mill Road, Bellefonte, Pa. 16823.

The sensor assembly 38 also includes a plug 46 mounted behind the piezoceramic element 50. The plug 38 is preferably formed from an electrically insulating material, such as a thermoplastic. It has external threads formed on its outside surface that mate with internal threads formed on a skirt portion of the diaphragm 44. A dowel pin 54 is disposed in mating holes 52 formed in the housing 72 and the diaphragm skirt 48 and prevents rotation of the sensor assembly 38.

In the preferred embodiment of the current invention, the piezoceramic element 50 is maintained in intimate surface contact with the diaphragm 46 by compressing the edges of the element between the rear face of the diaphragm and the plug 46. Thus, as shown best in FIG. 7, the plug 46 is threaded into the diaphragm skirt 48 so that it rests on the piezoelectric element 50, not the rear surface of the diaphragm face 45, thereby leaving a gap, indicated by G in FIG. 7, between the plug and the diaphragm face. In operation, the high pressure of the drilling mud 28 causes static deflection of the diaphragm face 45, while pressure pulsations in the drilling mud 28 cause vibratory deflection of the diaphragm face. Compressing the edges of the ceramic element 50 against the face of the diaphragm 44 ensures that the ceramic element will undergo vibratory deflections in response to vibratory deflections of the diaphragm face 45, thereby enhancing the sensitivity of the sensor 16.

However, although the compressive force supplied by the plug 46 is sufficient to restrain the piezoceramic element 50 axially—that is, in the direction parallel to the axis of the diaphragm skirt 48—it does not prevent relative sliding motion of the piezoceramic element the radial direction—that is, in the plane of the element 50. This prevents the piezoceramic element 50 from experiencing a large, static, tensile strain as a result of the static deflection of the diaphragm face 45, such as would occur if the piezoceramic element 50 were glued or otherwise completely restrained with respect to the diaphragm face 45. Such large tensile strains could result in failure of the piezoelectric element 50, which is relatively brittle. In one embodiment of the invention, the plug 46 is threaded into the diaphragm skirt 48 so as to apply a 100 pound preloaded to the piezoelectric element 50.

The conductor lead 56 from the piezoceramic element 50 extends through a potted grommet 57 on an intermediate support plate 55 formed in the plug 46, and terminates at a printed circuit board 74. The intermediate support plate 55 ensures that bending stresses are not imposed on the element from the conductor lead.

According to techniques well known in the art, the printed circuit board 74 incorporates the sensor electronics, such as that required to receive and analyze the signal from the piezoceramic element 50, as discussed below. Preferably, the printed circuit board 74 is mounted on a chassis 70, using mounting screws (not shown) or potting, that is supported within the housing 72, thereby protecting the board from shock and vibration. The conductor 56 feeds the output of the piezoceramic element 50 to the printed circuit board 74. Conductors 76 extend from the printed circuit board 74 to a conventional pin connector 64, thereby allowing the output of the sensor 16 to be electrically connected to the microprocessor 92, discussed above.

Figure 9:
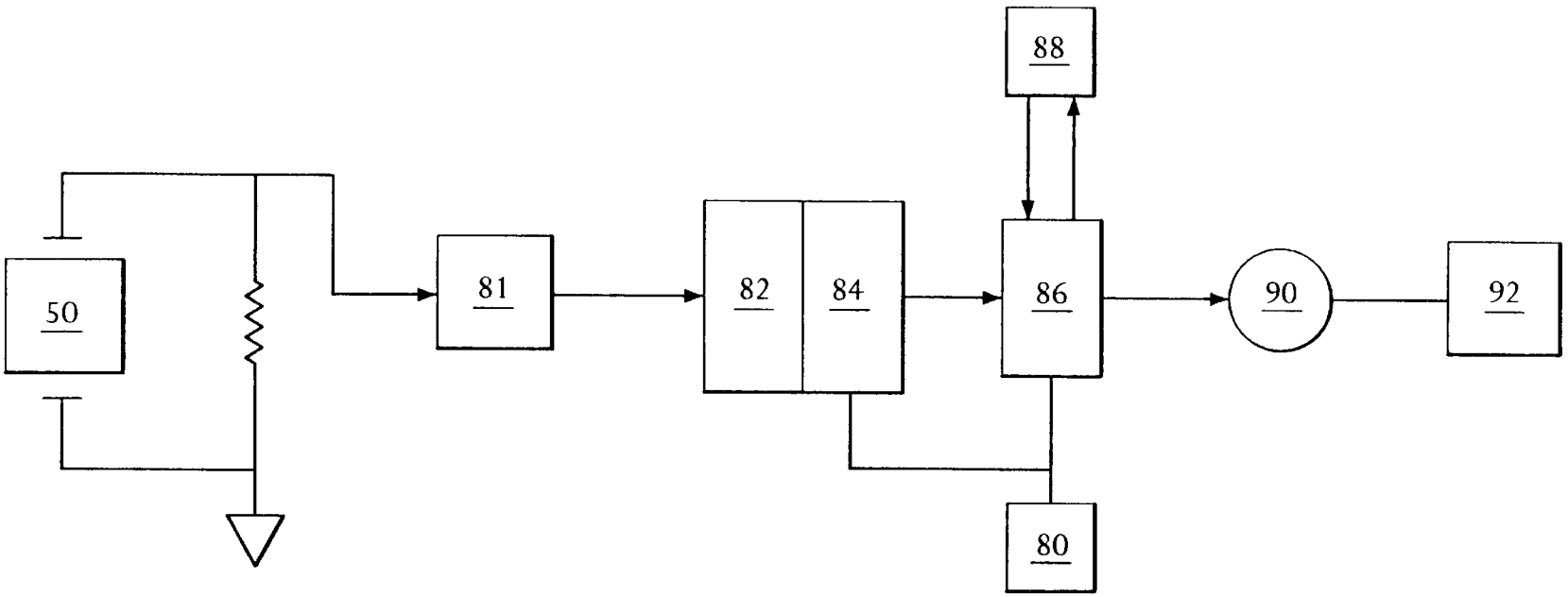
FIG. 9 is a schematic electrical diagram of the pressure pulsation sensor shown in FIGS. 4–7.
Figure 10:
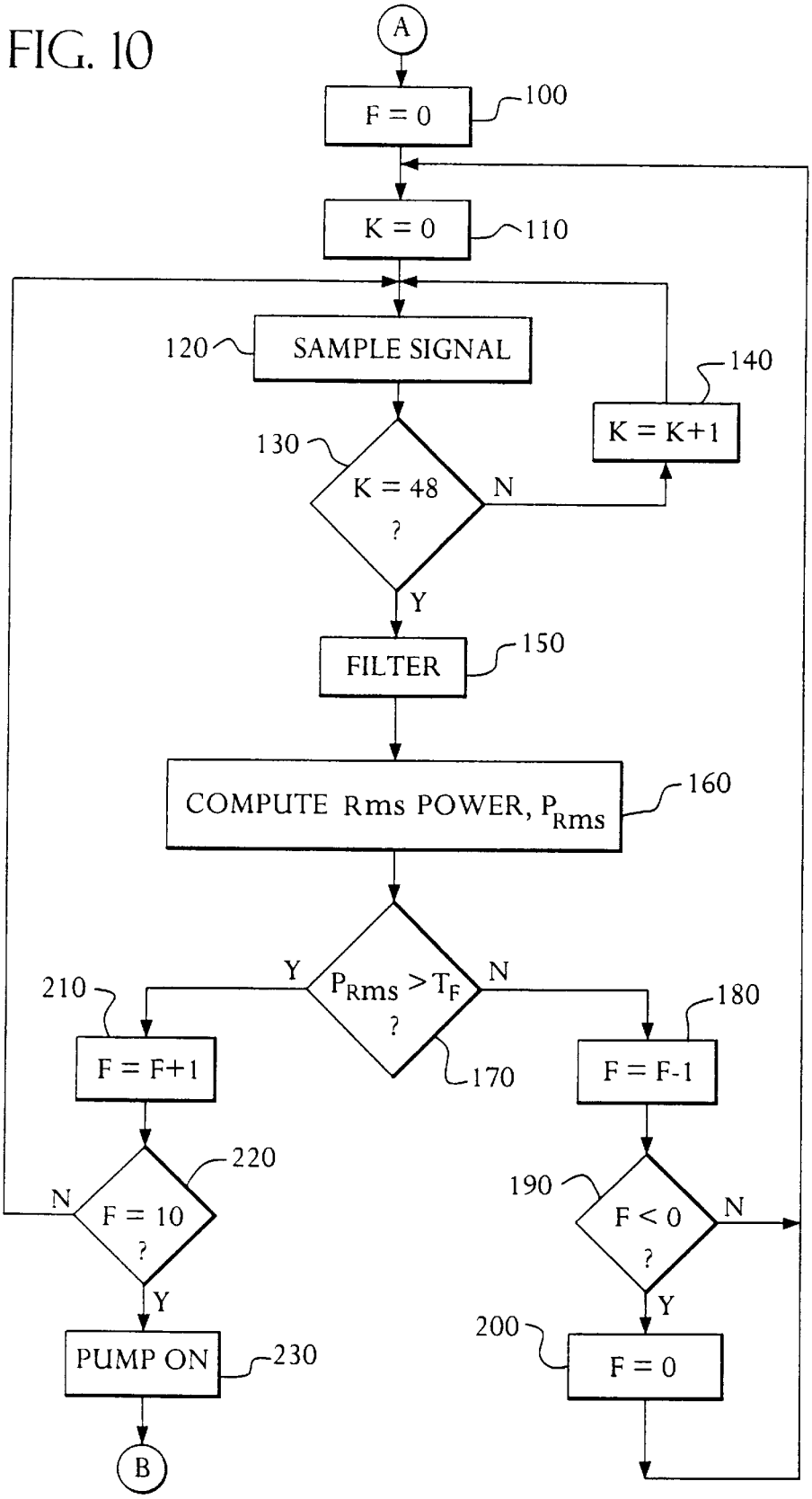
FIG. 10 is a flow chart showing the logic employed to determine if mud flow from the mud pumps has been established.

The logic used by the sensor electronics to determine whether mud pump operation, and therefore drilling fluid flow, has been established in the preferred embodiment of the invention is shown in FIG. 10. In steps 100 and 110, flow and sample counters F and K, respectively, are zeroed. In step 120, the instantaneous voltage signal generated by the piezoceramic element 50, which as previously discussed is proportional to its deflection, is sampled by averaging its value over a predetermined period, preferably 1/30 of a second. The voltage signal, which may be amplified, is preferably buffered by connecting an active filter 81, shown in FIG. 9, which preferably has approximately unity gain. This provides a high impedance input, removes any high frequency components, and biases the signal within the range of the analog to digital converter 84, discussed below. Preferably, thirty samples per second are taken over a 1.6 second window, resulting in an array of 48 samples, although it will be readily appreciated that other sampling frequencies and sampling windows could also be utilized. The signal is then AC coupled to a sophisticated programmable sigma-delta analog to digital converter 84, shown in FIG. 9. Suitable analog to digital converters are available from Analog Devices, Inc. of Norwood, Mass. Preferably, a high order programmable filter is incorporated into the analog to digital converter 84, thereby making it easy to reject all signals outside the frequency range of interest. The analog to digital converter is preferably programmed with a front-end gain of 8 and set up to acquire 16 bits of resolution. Thus, in steps 130 and 140, the sample count K is incremented with each sample collection until an array of 48 samples are obtained.

Since, according to the invention, the characteristic of the drilling mud pressure pulsations used to "code" the information contained in the pulsations is preferably their frequency, in step 150, the digitized array of samples is filtered using the programmable filter. In addition, the samples are further filtered using a comb filter with a null at DC and the first frequency null at 10 Hz so as to remove any residual DC bias in the input data and allow the data processing to be performed at the maximum possible precision. In most applications, filtering is preferably accomplished so as to remove the components of the pressure pulsation signal at frequencies below about 0.5 Hz, and to remove components above about 8 Hz, and preferably, above about 7.5 Hz. This is so because, as previously discussed, a single piston mud pump operating at the typical minimum rate of 30 strokes per minute will generate a pressure pulse 21 at a frequency of 0.5 Hz, while a triplex piston mud pump operating at the typical maximum rate of 150 strokes per minute may generate pressure pulses at a frequency as high as 7.5 Hz. However, as those skilled in the art will readily recognize, other frequency ranges could also be selected for non-typical drilling operations, such as operations employing more than three pistons or in which unusually high or low stroke rates were used. The filter function used in the practice of the current invention may be in the form: $y(n)=x(n-3)-x(n)$, where $x(n)$ is the nth sample and $y(n)$ is the nth filtered sample. However, as those skilled in the art will readily appreciate, many other filtering functions could also be utilized. In any event, in step 160, the root mean square power $P_{RMS}$ of the filtered, digitized voltage signal from the piezoceramic element 50 is computed.

In step 170, the root mean square power $P_{RMS}$ of the filtered signal is compared to a predetermined, but programmable, minimum threshold value. In some applications, this value should correspond to about a 1 psi variation in drilling mud pressure. However, since parameters such as the depth of the well and the type of drilling mud will affect the minimum threshold value, the value is programmable and can be adjusted based on field experience. If the power does not exceed the minimum threshold value (which would occur if the mud pump were not operating), the flow count F is decremented and compared to zero in steps 180 and 190. If the flow count is not less than zero, steps 110 to 170 are repeated—that is, another array of data is acquired and tested. If the flow count is less than zero, it is reset to zero in step 200 and steps 110 to 170 are then repeated.

If the root means square power of the filtered sample data exceeds the minimum threshold value (which would occur if the mud pump were operating), the flow count F is incremented and then compared to a predetermined, but programmable, value (such as 10) in steps 210 and 220. If the flow count equals that value, the sensor 16 trips a logic switch in step 230 that signals the microprocessor 92 that the mud pumps are operating.

Thus, according to the preferred embodiment of the invention, the sensor 16 determines that the mud pump is operating, and therefore that drilling mud is flowing and drilling is underway, if the instances of relatively high pressure pulsations in the appropriate frequency range—that is, instances in which the root mean square power of a filtered sample array of voltages from the piezoceramic element exceeds a predetermined minimum threshold value—occur with sufficient regularity. Sufficient regularity is found if, in comparison to the regularity of the instances in which the minimum threshold value is not exceeded, the regularity of the instances in which the minimum threshold value is exceeded causes a count that is incremented when the threshold value is exceeded, and decremented when it is not, to reach a predetermined minimum value, such as 10.

As previously discussed, the signal from the sensor 16 to the microprocessor 92 indicating the mud pump has begun operating, after previously having determined that the pump was not operating (using logic discussed below), can be used in a variety of ways. For example, it can trigger the restoration of electrical power to the MWD tool, the transmission a certain types of data, such as directional data, or the initialization of data transmission according to a predetermined format so as to allow the surface data acquisition system to be resynchronized.

Figure 11:
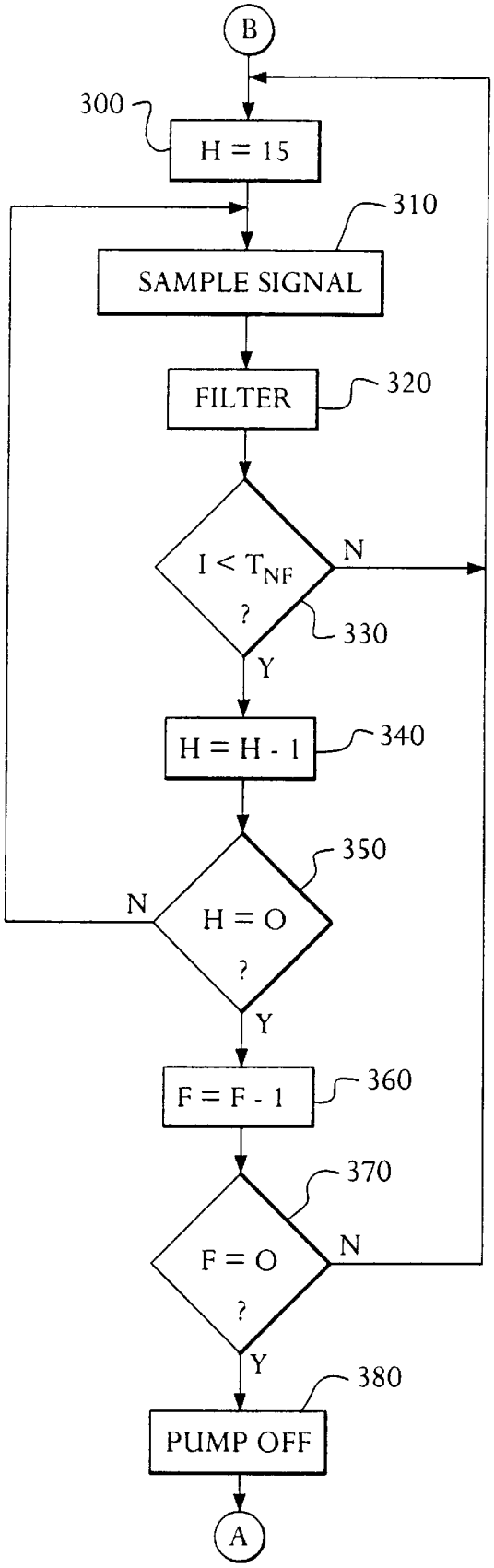
FIG. 11 is a flow chart showing the logic employed to determine if mud flow from the mud pumps has ceased.

Once the sensor 16 has determined that operation of the mud pump has been established, it begins checking to determine if operation subsequently ceases. The logic of this process is shown in FIG. 11. In step 300, a sample count H is set to a predetermined, but programmable, value, such as 15. A single sample is then taken of the voltage from the piezoceramic element 50 in step 310. This signal is then filtered as described above in connection with the logic described in FIG. 10.

In step 330, the amplitude of the filtered voltage signal is compared to a predetermined, but programmable, maximum threshold value, such as 0.5 psi, that is preferably different from the threshold value discussed in connection with FIG. 10 to provide some hysteresis. If the value is not less than the maximum threshold (which would occur whenever the mud pump were operating), the sample count H is reset and steps 310–330 are repeated. If the value is less than the maximum threshold (which would occur when the mud pump were not operating), the sample count is decremented and then compared to zero in steps 340 and 350. If the sample count is not yet equal to zero, steps 310–350 are repeated. If the sample count has reached zero, meaning that the value has been below the maximum threshold for fifteen consecutive samples (i.e., over a 0.5 second period if the sampling rate is 30 per second), the flow count F, which was set to a predetermined value, such as 10, by the logic in FIG. 10, is decremented and then compared to zero in steps 360 and 370. If the flow count is not yet zero, steps 300 to 370 are repeated. If the flow count equals zero, the sensor 16 trips the logic switch in step 380 thereby signaling the microprocessor 92 that the mud pump has ceased operating.

Thus, according to the preferred embodiment of the invention, the sensor 16 determines that the mud pump has ceased operating, and therefore that drilling mud is not flowing and drilling is not underway, if the instances of a certain situation—i.e., those in which the filtered value of the voltage from the piezoceramic element is less than a predetermined maximum threshold value for a predetermined number of consecutive times, such as 15—occur a sufficient number of times, such as 10.

As previously discussed, a signal from the sensor 16 to the microprocessor 92 indicating that mud flow has ceased, after previously having determined that mud flow had been established, can be used, for example, to trigger a reduction, or complete cut-off, in the electrical power supplied to the MWD tool, or the initiation of the transmission of directional or other data, or the re-initializing of the data transmission sequence according to a predetermined format so that the surface acquisition system could be resynchronized.

Once the sensor 16 has determined that operation of the mud pump has ceased, it begins checking to determine if operation has subsequently been reestablished using the logic shown in FIG. 10.

An electrical diagram showing the electronic components that perform the data sampling and analysis described above is shown in FIG. 9. As can be seen, the components include (i) the piezoceramic element 50 for generating a varying voltage signal in response to pressure pulsations, (ii) an active filter 81, (iii) an analog to digital converter 84 for digitizing the piezoceramic element signal, (iv) a programmable filter 82, which is incorporated into the analog to digital converter, for filtering out the portion of the signal from the piezoceramic element outside of a predetermined frequency range, (v) a sensor microprocessor 86 that, using techniques well known in the art, is programed with software for performing the logic operations previously discussed including incrementing and decrementing the counters and comparing the amplitude of the piezoceramic signal to predetermined threshold values, (vi) an EPROM 88 for storing programmable thresholds and data, (vii) a crystal oscillator 80, and (viii) a logic switch 90 for signaling the bottom hole assembly microprocessor 92 that operation of the mud pump has been established or has ceased.

Although the current invention has been illustrated by reference to communicating information to the bottom hole assembly concerning whether the mud pump is operating, the invention could also be practiced by communicating other information from the surface to the bottom hole assembly, such as steering directions in a steerable drill string. Further, although the invention has been illustrated by analyzing the pressure pulsations attributable to the mud pump pistons, other sources of pressure pulsations, such as a pulser valve discussed below, could also be used to communicate with the bottom hole assembly.

Figure 12:
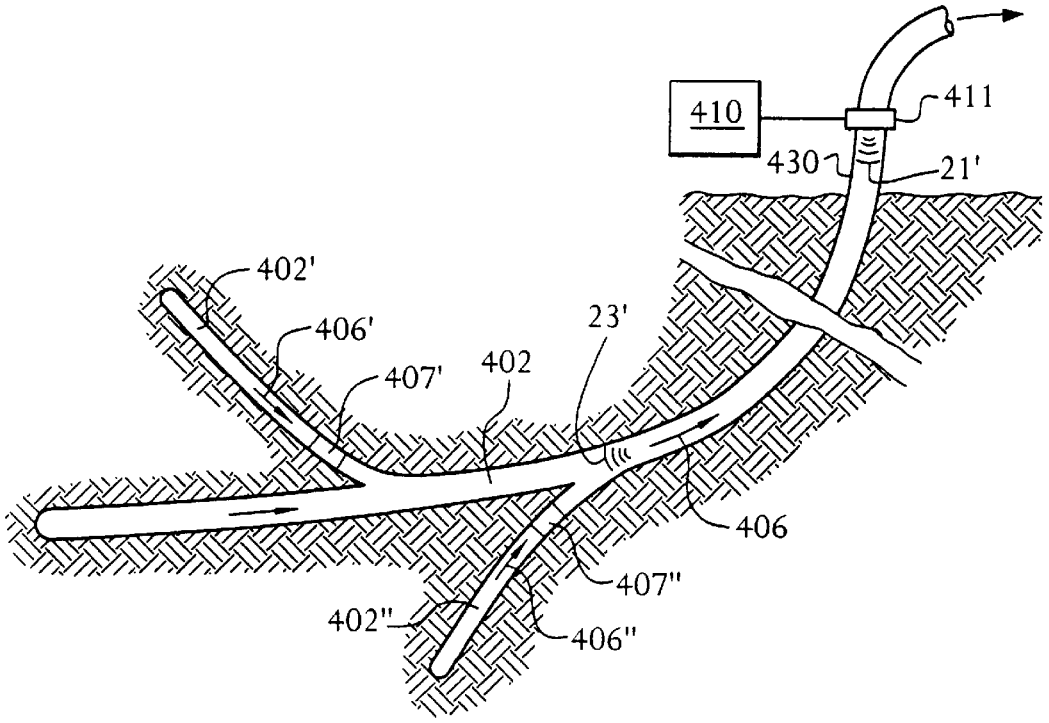
FIG. 12 is a diagram, partially schematic, of a multilateral producing well incorporating remotely operated flow control devices according to the current invention that control the flow of fluid from the well branches.

The current invention is not limited to communicating information to a bottom hole assembly in a drill string but may also be used to communicate information to a device, such as a flow control device, in a producing well. A typical multilateral producing well 402 is shown in FIG. 12. A number of branches, such as branches 402' and 402", extend from the main well bore at various locations. The fluid 406' and 406" from each of the branches commingles in the well and flows up to the surface as a combined flow 406. For a variety of reasons, it is sometimes desirable to regulate, or entirely stop, the flow of fluid from one of the branches.

Figure 13:
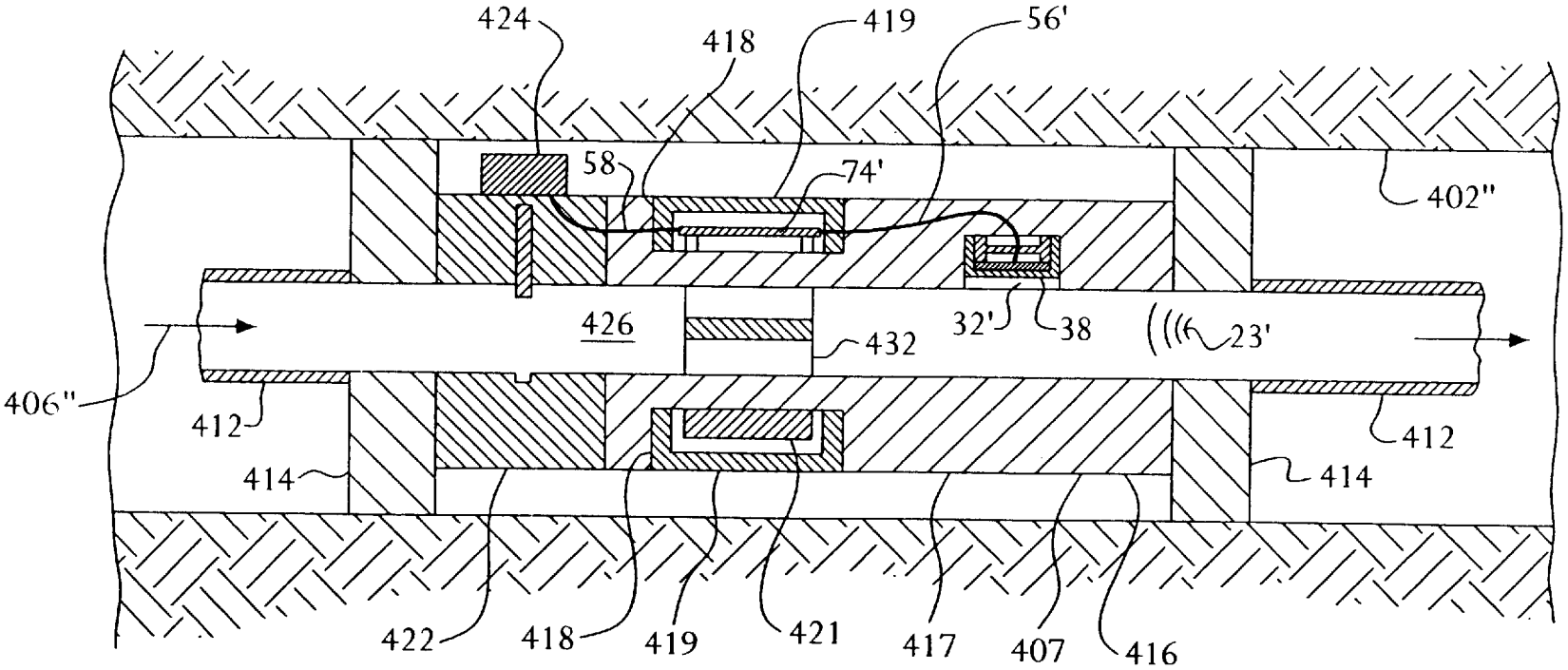
FIG. 13 is a longitudinal cross-section, partially schematic, of one of the remotely operated flow control devices shown in FIG. 12.

According to the current invention, such flow control is readily remotely accomplished from the surface by incorporating a flow control device 407, shown in detail in FIG. 13, into each branch 402' and 402" of the well 402 and by installing a pressure pulsation generating device 411 in the fluid discharge piping 430 at the surface. The pressure pulsation generating device 411, which is preferably a pulser valve similar to that currently found in MWD tools used in mud pulse telemetry systems, is controlled by a controller 410. Under the direction of the controller 410, the pulser 411 alternately restricts and unrestricts the flow of fluid 406 from the well 402, thereby generating pressure pulses 21' in the fluid. The pressure pulsations are transmitted down the well 402 and are received as attenuated pressure pulsations 23' at the flow control devices 407 installed in each of the well branches 402' and 402". In the flow control devices 407, the pressure pulsations are sensed by pressure pulsation sensors 416 mounted in the flow control device. Preferably, the pressure pulsation sensors 416 are similar to the pressure pulsation sensor 16 intended for use in the bottom hole assembly that is discussed above in connection with the embodiments shown FIGS. 1–11.

One embodiment of a flow control device 407 for use in a multilateral well according to the current invention is shown in FIG. 13. As is conventional, fluid production tubing 412 is disposed within the well bore 402" and directs the flow of well fluid 406" to the surface. A central passage 426 is formed within the flow control device 407 that allows fluid 406" from the well to flow through the device. Isolation packers 414 at each end of the device 407 mate with the production tubing 412 and prevent fluid 406" from flowing around the device. The device 407 further includes a valve 422, a pressure pulsation sensor 416, and a turbine alternator 432. The valve 422 may be a gate valve or any other conventional fluid flow isolation or control valve, and incorporates a motor driven operator 424. The turbine alternator 432 is disposed within the central passage 426 and is driven by the well fluid 406".

The pressure pulsation sensor 416 is comprised of a cylindrical metal housing 417 in which a number of recesses are formed. Recess 32', which may be similar to recess 32 previously discussed in connection with FIGS. 4–8, houses the pressure sensor assembly 38 shown in FIGS. 6–8. As previously discussed, the pressure assembly 38 preferably contains a piezoceramic element that generates a voltage in response to pressure changes within the fluid 406". Two additional recesses 418 are also formed in the housing 417, each of which is sealed by a hatch cover 419. The electronics package 74' for the flow control device 407, which preferably includes a printed circuit board, is housed within one of the recesses 418, while a battery 421 is mounted within the other recess 418. The battery 421 provides electrical power for the flow control device 407, including power for the valve 422 operator 424, and is trickle charged by the turbine alternator 432. A conductor 56' electrically connects the pressure sensor assembly 32 to the electronics package 74'. A second conductor 58 electrically connects the electronics package 74' to the valve operator 424.

The electronics package 74' preferably contains the electronic components and logic previously discussed in connection with FIGS. 9 and 10 that enable the pressure pulsation sensor 416 to reliably analyze a characteristic of the pressure pulsations, such as whether they contain pulsations within a predetermine frequency range, and thereby recognize whether a communication is being directed to it and, if so, what action should be taken. For example, if the pressure pulsation sensor 416 in flow control device 407" installed in branch 402" determines that the frequency of the pulsations 23' is in the 5 to 7 Hz range, it will direct a signal, via conductor 58, to the valve operator 424 causing it to close, or partially close, the valve 422. However, if the sensor 416 determines that the frequency is in the 8 to 10 Hz range, it will open, or partially open, the valve. The pressure sensor 416 in the flow control device 407' in the other well branch 402' is programed to ignore pulsations within the 5–10 Hz range. Instead, it will close its valve 422 if the frequency is in the 13 to 15 Hz range and open its valve if the frequency is in the 16 to 18 Hz range; frequencies that the sensor 416 in branch 407" are programed to ignore.

Thus, the flow control device 407 of the current invention allows well operating personnel to readily control the flow of fluid from the various branches in a multilateral producing well from the surface, and without a direct data link to the valves in the branches.

Although the invention has been illustrated by using the frequency of the pressure pulsations to communicate information, other characteristics of the pressure pulsations, such as pulse pattern or duration, could also be used. In connection with the embodiment shown in FIGS. 12 and 13, for example, the pressure pulsations 21' could contain information encoded in a binary format such as that currently employed in mud pulse telemetry systems, thereby allowing the communication of more complex directives rather than merely opening and closing and the control of devices other than valves. In that event, additional microprocessor capability and more sophisticated data acquisition system would be incorporated into the down hole device.

Accordingly, the present invention may be embodied in other specific forms without departing from the spirit or essential attributes thereof and, accordingly, reference should be made to the appended claims, rather than to the foregoing specification, as indicating the scope of the invention.

What is claimed:

1. A method of performing a drilling operation in which a bore is drilled in an earthen formation using a drill string to which a drill bit is coupled at a distal end thereof, comprising the steps of:

a) pumping a drilling mud through said drill string to said drill bit whenever said drill bit is rotated so as to drill said bore, said drilling mud being pumped using one or more pistons operating at a stroke rate and generating pressure pulsations in said drilling mud flowing through said drill string;

b) sensing pressure pulsations in said drilling mud in a down hole portion of said drill string proximate said drill bit; and c) determining whether said drilling mud is being pumped through said drill string by analyzing a characteristic of said pressure pulsations sensed in said down hole portion.

2. The method according to claim 1, further comprising the steps of:

d) directing a flow of electricity from a battery to a component disposed in said down hole portion of said drill string; and e) reducing said flow of electricity from said battery to said component if it is determined in step (c) that said drilling mud is not being pumped through said drill string.

3. The method according to claim 2, further comprising repeating steps (b) and (c), and further comprising the step of increasing said flow of electricity from said battery to said component if following a determination that said drilling mud is not being pumped in one performance of said step (c) it is subsequently determined in another performance of step (c) that said drilling mud is being pumped through said drill string.

4. The method according to claim 2, further comprising the steps of sensing an aspect of said drilling operation by directing a flow of electricity to a sensor disposed in said down hole portion of said drill string, and wherein the step of reducing said flow of electricity comprises reducing said flow of electricity to said sensor.

5. The method according to claim 1, wherein steps (b) and (c) are repeatedly performed, and further comprising the step of initiating transmission of data to the surface of the earth by generating pressure pulsations in said drilling mud at said down hole portion of said drill string if following a determination that said drilling mud is not being pumped in one performance of said step (c) it is subsequently determined in another performance of step (c) that said drilling mud is being pumped through said drill string.

6. The method according to claim 5, further comprising the step of measuring an aspect of said drilling operation using a sensor, and wherein said data in said transmission includes data representative of said aspect measured.

7. The method according to claim 1, wherein the step of sensing pressure pulsations in said drilling mud comprises causing the pressure of said drilling mud to deflect a piezoelectric element disposed proximate said drill bit so as to produce a voltage within said piezoelectric element, the amplitude of said voltage being proportional to the amplitude of said pressure.

8. The method according to claim 7, wherein said piezoelectric element comprises a piezoceramic element.

9. The method according to claim 1, wherein said characteristic of said pressure pulsations analyzed in step (c) comprises the frequency of said pressure pulsations.

10. The method according to claim 9, wherein the step of analyzing said frequency of said pressure pulsations comprises filtering out frequencies above a predetermined value.

11. The method according to claim 10, wherein said predetermined frequency value is approximately equal to the number of said one or more pistons used to pump said mud multiplied by said stroke rate.

12. The method according to claim 1, wherein the step of sensing said pressure pulsations in said drilling mud comprises generating a signal representative of the amplitude of said pressure pulsations, and wherein the step of analyzing said pressure pulsations comprises determining whether said amplitude exceeds a predetermined minimum threshold value with at least a predetermined degree of regularity.

13. The method according to claim 12, wherein the step of determining whether said amplitude exceeds said predetermined minimum threshold value with at least said predetermined degree of regularity comprises filtering out the portion of said pressure pulsations having a frequency outside of a predetermined frequency range.

14. The method according to claim 12, wherein the step of determining whether said amplitude exceeds said predetermined minimum threshold value with at least said predetermined degree of regularity comprises the steps of:

a) incrementing a count each time said amplitude exceeds said predetermined minimum threshold value;

b) decrementing said count each time said amplitude fails to exceed said predetermined value; and c) comparing the value of said count to a predetermined value.

15. The method according to claim 1, wherein the step of sensing said pressure pulsations in said drilling mud comprises generating a signal representative of the amplitude of said pressure pulsations, and wherein the step of analyzing a characteristic of said pressure pulsations comprises determining whether said amplitude falls below a predetermined maximum threshold value with at least a predetermined degree of regularity.

16. The method according to claim 15, wherein the step of determining whether said amplitude falls below said predetermined maximum threshold value with at least said predetermined degree of regularity comprises determining whether the portion of said amplitude within a predetermined frequency range falls below said predetermined maximum threshold value with at least said predetermined degree of regularity.

17. In a drill string having a drill bit and through which a drilling mud is pumped by at least one pump having at least one piston stroked at a stroke rate within a predetermined range, a method of determining whether said pump is pumping said mud, comprising the steps of:

a) sensing pressure pulsations in said drilling mud proximate said drill bit;

b) determining whether the amplitude of the portion of said pressure pulsations that is within a predetermined frequency range exceeds a predetermined value; and c) determining that said pump is pumping said mud based on said comparison in step (b).

18. The method according to claim 17, wherein the step of sensing said pressure pulsations comprises the step of deflecting a piezoelectric element disposed proximate said drill bit so as to produce a voltage within said piezoelectric element, the amplitude of said voltage being proportional to the amplitude of said pressure pulsations.

19. The method according to claim 18, wherein said piezoelectric element comprises a piezoceramic element.

20. The method according to claim 17, wherein the step of determining whether the amplitude of the portion of said pressure pulsations that is within a predetermined frequency range exceeds a predetermined value comprises determining whether the amplitude of said portion of said pressure pulsations that is within said predetermined frequency range exceeds said predetermined value with at least a predetermined degree of regularity.

21. A method of communicating steering command information to a steerable bottom hole assembly disposed in a well bore from a location on the earth's surface, said bottom hole assembly being surrounded by a fluid and being a portion of a drill string, the method comprising the steps of:

a) directing pressure pulsations down said fluid to said bottom hole assembly from said surface location, said pressure pulsations having a characteristic indicative of said steering command information to be communicated;

b) sensing said pressure pulsations received at said bottom hole assembly; and c) analyzing said characteristic of said pressure pulsations in said bottom hole assembly so as to decipher said steering command information being communicated.

22. The method according to claim 21, wherein the step of sensing said pressure pulsations comprises the steps of:

a) causing a piezoelectric element to vibrate in response to said pressure pulsations so as to generate a varying voltage within said piezoelectric element; and b) taking periodic measurements of said varying voltage.

23. The method according to claim 22, wherein said piezoelectric element comprises a piezoceramic element.

24. An apparatus for use in a drill string for sensing pressure pulsation in a drilling fluid surrounding said bottom hole assembly, comprising:

a) a bottom hole assembly in which a housing is mounted;

b) a flexible diaphragm mounted in said housing, said diaphragm having a face exposed to said drilling fluid;

c) a piezoelectric element coupled to said diaphragm face so that deflections of said diaphragm cause deflections of said piezoelectric element, said piezoelectric electric element having means for generating a varying voltage signal in response to said deflections thereof.

25. The apparatus according to claim 24, wherein said piezoelectric element comprises a piezoceramic element.

26. The apparatus according to claim 24, further comprising means for analyzing said varying voltage signal mounted in said housing.

27. The apparatus according to claim 26, wherein said means for analyzing said varying voltage signal comprises a filter.

28. The apparatus according to claim 26, further comprising a microprocessor programed with software for analyzing said varying voltage signal.

29. A method of regulating the flow of fluid from a producing well by controlling a valve located down hole in said well from a location on the earth's surface, the method comprising the steps of:

a) locating a pressure pulsation sensor assembly in said well proximate said valve;

b) directing pressure pulsations down said fluid to said sensor assembly from said surface location, said pressure pulsations having a characteristic indicative of an instruction to be communicated for controlling said valve;

c) sensing said characteristic of said pressure pulsations received by said sensor assembly;

d) analyzing said characteristic of said sensed pressure pulsations so as to decipher said instruction, said analysis being conducted down hole in said well;

e) sending a signal from said sensor assembly to said valve instructing said valve to operate in accordance with said instruction deciphered by said sensor assembly; and f) operating said valve in accordance with said instruction so as to regulate the flow of said fluid produced by said well.

30. The method according to claim 29, wherein the step of sensing said pressure pulsations comprises the steps of:

a) causing a piezoelectric element to vibrate in response to said pressure pulsations so as to generate a varying voltage within said piezoelectric element; and b) taking periodic measurements of said varying voltage.

31. The method according to claim 30, wherein said piezoelectric element comprises a piezoceramic element.

32. An apparatus for controlling the flow of fluid from a multilateral well having at least first and second branches, comprising:

a) first and second fluid flow control devices for controlling the flow of fluid downhole in said first and second branches of said multilateral well, respectively, in response to a signal received;

b) means for generating pressure pulsations in said fluid proximate the surface of the earth for transmission downhole to said first and second branches of said multilateral well, said pressure pulsations having a characteristic indicative of an instruction for operating at least one of said first and second fluid flow control devices;

c) at least one sensor assembly for sensing said pressure pulsations at a location downhole in said well; and d) a microprocessor for analyzing said characteristic of said pressure pulsations sensed so as to decipher said instruction and for sending a signal to at least one of said first and second fluid flow control devices instructing said device to operate in accordance with said instruction.

33. The apparatus according to claim 32, wherein said means for generating pressure pulsations comprises a pulser valve.

34. The apparatus according to claim 32, wherein said first and second fluid flow control devices each comprise a shutoff valve.

35. The apparatus according to claim 32, wherein said sensor assembly comprises:

a) a housing;

b) a flexible diaphragm mounted in said housing, said diaphragm having a face exposed to said drilling fluid;

c) a piezoelectric element coupled to said diaphragm face so that deflections of said diaphragm cause deflections of said piezoceramic element, said piezoelectric electric element having means for generating a varying voltage signal in response to said deflections thereof.

36. The apparatus according to claim 35, wherein said piezoelectric element comprises a piezoceramic element.

37. The apparatus according to claim 35, wherein said microprocessor is mounted in said housing.

38. The apparatus according to claim 32, further comprising a filter electrically connected to said microprocessor.

39. The apparatus according to claim 32, wherein said microprocessor is programed with software for analyzing said pressure pulsations.

40. In a multilateral well having at least first and second branches into which first and second flow control devices, respectively, are installed, each of said first and second flow control devices being operative in response to a signal received, a method for individually controlling the flow of fluid from at least said first and second branches, comprising the steps of:

a) generating pressure pulsations in said fluid proximate the surface of the earth for transmission downhole to at least a selected one of said first and second branches of said multilateral well whose fluid flow is to be controlled, said pressure pulsations having a characteristic indicative of an instruction for operating the one of said first and second fluid flow control devices installed in said selected branch;

b) sensing said pressure pulsations at a location downhole in said well;

d) analyzing said characteristic of said pressure pulsations sensed so as to decipher said instruction;

e) sending a signal to at least said one of said fluid flow control devices installed in said selected branch instructing said device to operate in accordance with said instruction;

f) operating at least said one of said fluid flow control devices to which said signal was sent so as to control the flow of fluid from said selected branch.

* * * * *

UNITED STATES PATENT AND TRADEMARK OFFICE

CERTIFICATE OF CORRECTION

PATENT NO. : 6,105,690
DATED : August 22, 2000
INVENTOR(S) : Biglin, Jr. et al.

It is certified that error appears in the above-identified patent and that said Letters Patent is hereby corrected as shown below:

Column 3,
Line 42, please delete "indication" and insert therefor -- indicating --.

Column 8,
Line 49, please delete "come" and insert therefor -- some --.

Column 11,
Line 44, please delete the word "a" and insert therefor -- of --.

Column 18, claim 35,
Line 26, please delete "drilling" and after the word "fluid" insert -- flowing downhole in said well --.

Signed and Sealed this

Twelfth Day of February, 2002

*Attest:*

*Attesting Officer*

JAMES E. ROGAN
*Director of the United States Patent and Trademark Office*